United States Patent [19]

Cordell

[11] Patent Number: 5,066,002

[45] Date of Patent: Nov. 19, 1991

[54] PORTABLE EXERCISE DEVICE

[76] Inventor: Melinda Cordell, 10965 Fruitland Dr., #310, Studio City, Calif. 91604

[21] Appl. No.: 505,294

[22] Filed: Apr. 5, 1990

[51] Int. Cl.[5] ..... A63B 23/02

[52] U.S. Cl. ..... 272/93; 272/132

[58] Field of Search ..... 272/62, 93, 109, 132, 272/143, 145; 248/230; 74/551.8, 551.9, 552, 553

[56] References Cited

U.S. PATENT DOCUMENTS

| | | | |
|---|---|---|---|
| 296,973 | 4/1884 | Kelsey | 74/551.9 |
| 938,045 | 10/1909 | Fay | 272/116 R |
| 1,258,647 | 3/1918 | Bowers | 74/551.9 |
| 2,727,406 | 12/1955 | Opocensky | 74/553 |
| 3,811,672 | 5/1974 | Simmons | 272/67 |
| 4,002,236 | 1/1977 | Tolleson | 135/66 |
| 4,116,434 | 9/1978 | Bernstein | 272/93 |
| 4,126,307 | 11/1978 | Stevenson | 272/62 |
| 4,722,523 | 2/1988 | Yang | 272/62 |

FOREIGN PATENT DOCUMENTS

| | | | |
|---|---|---|---|
| 2315291 | 1/1977 | France | 272/109 |

*Primary Examiner*—Richard J. Apley
*Assistant Examiner*—Jerome Donnelly
*Attorney, Agent, or Firm*—Nilsson, Robbins, Dalgarn, Berliner, Carson & Wurst

[57] ABSTRACT

A lightweight exercise device utilizes a hollow barre, a t-clamp, a support member and a support clamp to provide a portable barre which may be used under diverse circumstances and mounted on a wide variety of already existing foundations. The barre may be positioned to a fixed foundation such that it is above, horizontal to, perpendicular to, or below the foundation. The inner chamber of the barre is utilized as a storage compartment to store the remaining elements of the exercise device. A separate compartment within the inner chamber holds valuables, money, keys or the like.

6 Claims, 5 Drawing Sheets

FIG. 1
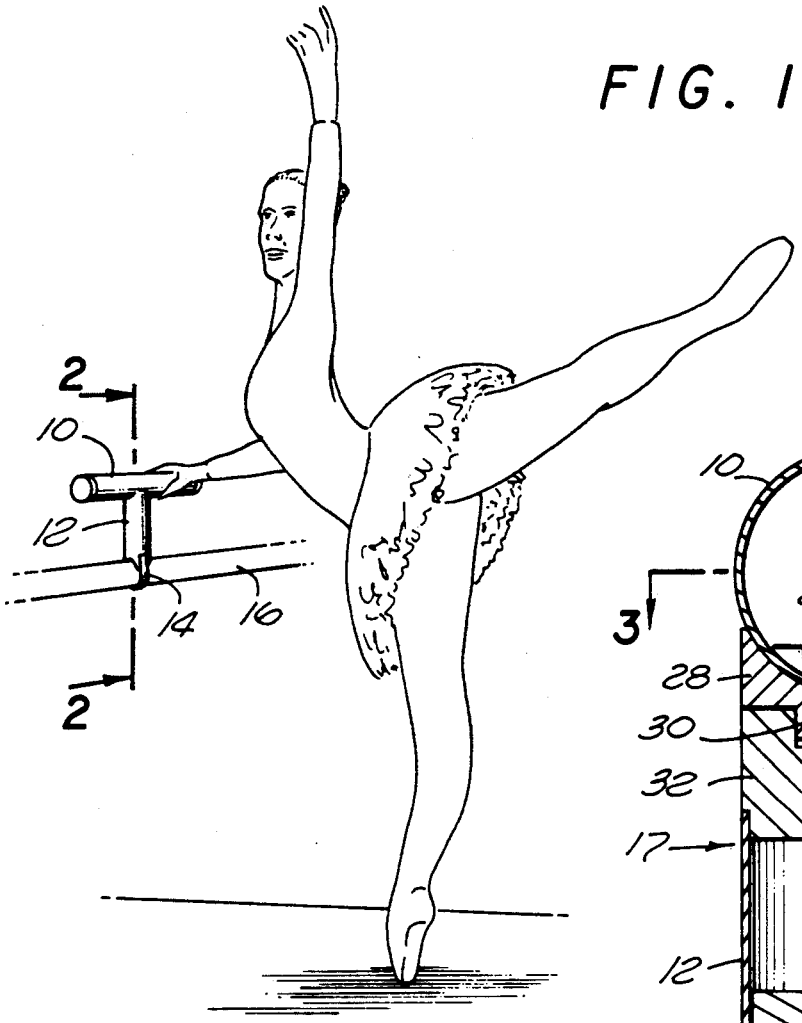
FIG. 2
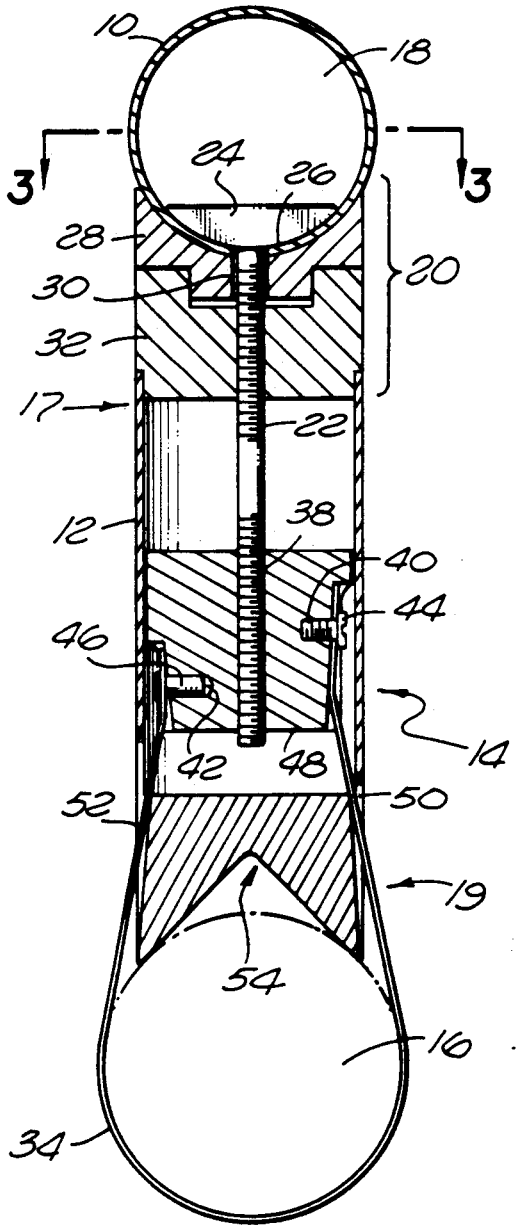
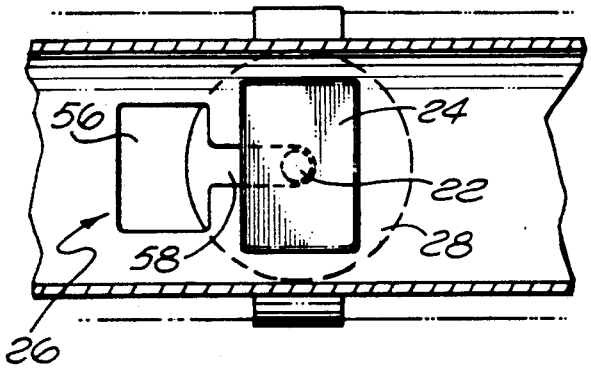
FIG. 3

FIG. 4
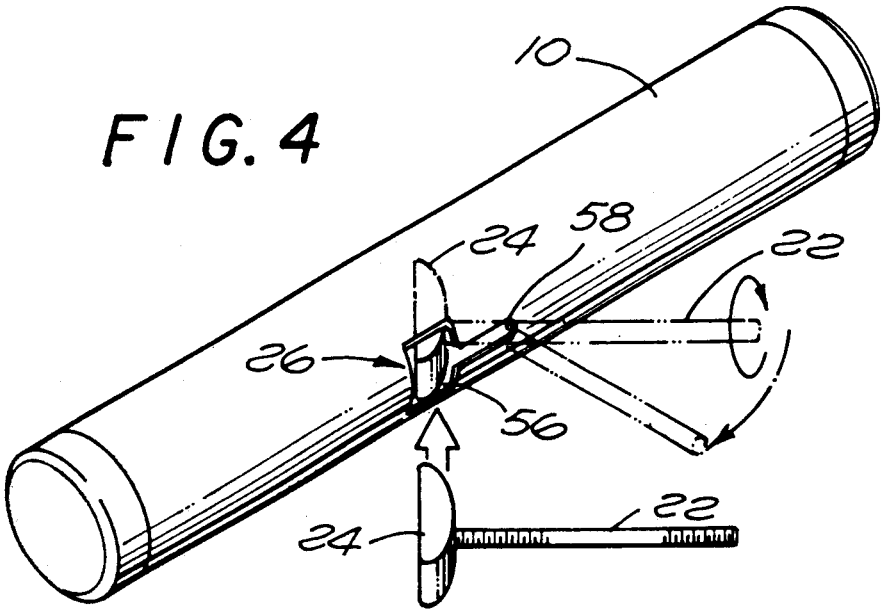
FIG. 5
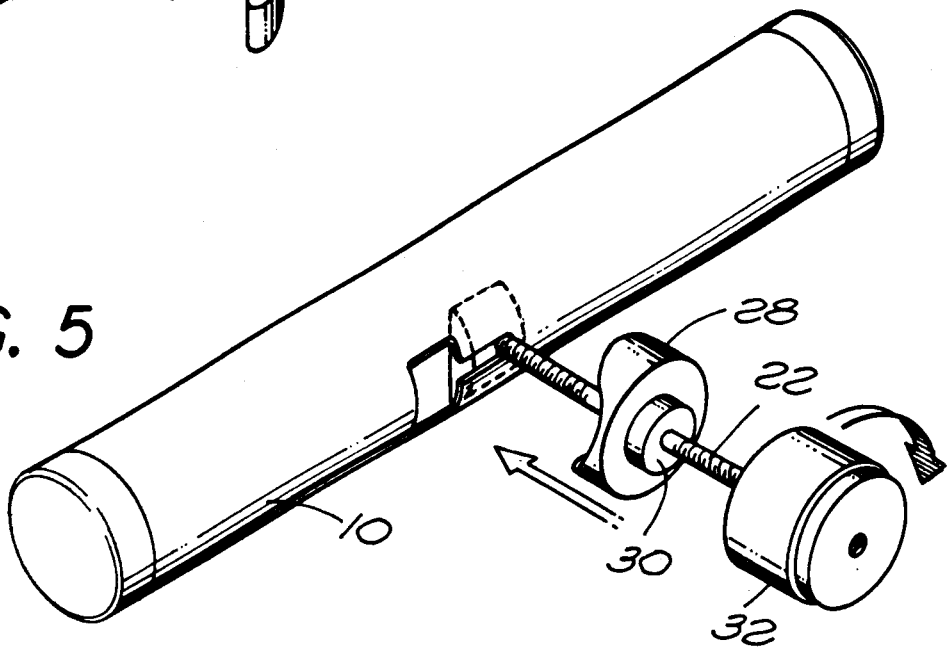
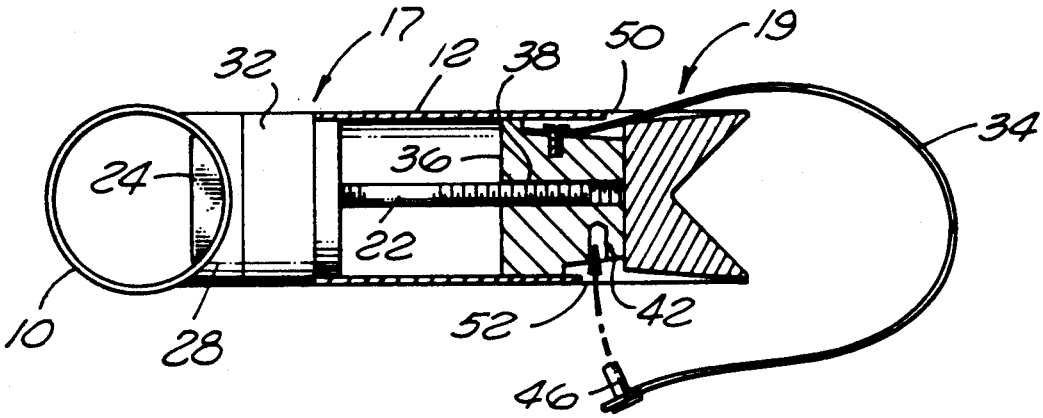
FIG. 6

PORTABLE EXERCISE DEVICE

BACKGROUND OF THE INVENTION

The present invention relates to exercise apparatuses and, more particularly, to a lightweight portable ballet barre which may be disassembled and stored within its own cylinder, for use by ballet dancers, athletes and others who desire a portable, easily carried exercise barre.

Traditionally, ballet dancers warm up prior to performances and during class by exercising at a ballet barre. Generally, in dance studios, ballet barres are made from smooth wooden poles which are permanently mounted to the studio wall. Alternatively, free standing barres mounted on heavy metal uprights are used. Both wall mounted and free standing barres provide support to allow a dancer to warm up slowly, thus lessening the danger of muscle strain and sprain, pulled tendons, torn ligaments and other bodily injuries that threaten athletes and dancers. Athletes also require a proper warm-up prior to engaging in their athletic activities.

During exercises at the barre, it is important to maintain a proper posture. Therefore, the height of the barre must be such that when the user's hand rests on the barre, the hand is at approximately hip level without the shoulder being raised or the back being slouched. Thus, for example, many ballet studios use dual wall-mounted barres to accommodate adults and/or children.

Unfortunately, even the use of dual mounted studio barres is not adequate to provide many children, women and most men with a barre at an ideal height. Thus, a need exists for a barre which may be easily mounted on existing studio barres to accommodate shorter and taller than average dancers. Such a barre would allow not only individuals, but ballet studios, gymnasiums, sports facilities and the like to adequately provide support for people of non-average height without the added expense of permanently mounting additional barres.

A need also exists for a barre which is adaptable to non-studio environments. For example, when professional dancers tour, they often perform in theaters without permanent wall-mounted barres or without adequate free-standing barres to accommodate all of the dancers. Therefore, professional dancers must often warm up prior to a performance by using pipes, chairs, and any other object which will provide support during warm up exercises.

Unfortunately, objects such as a chair rarely provide the strength necessary to adequately support a dancer during strenuous warm up exercises. Indeed, male dancers exert such pressure on their warm up supports that any object which is not securely fixed will not support their weight. Thus, even free standing barres often will move under the weight of a male dancer. Therefore, a need exists for a barre which may be mounted on a wide variety of fixed objects. Such a barre would allow professional dancers to clamp the barre on fixed objects in theaters for warm up purposes. Additionally, such a barre should be portable and compact to allow dancers to easily transport the barre between theaters anywhere in the world.

Exercise barres such as those disclosed in U.S. Pat. Nos. 4,116,434 and 4,185,816, issued to Bernstein, disclose a sit-up exercise apparatus incorporating a bar and clamp device for mounting underneath a door. The bars are located adjacent to the floor, for use while seated on the floor.

U.S. Pat. No. 938,045, issued to Fay, discloses a portable barre which may be mounted on a doorknob. Although the Fay barre is attached at a height which is more appropriate for ballet dancers, it is not readily adjustable to accommodate tall or short dancers. Nor, is it capable of being mounted on any other fixed object other than a doorknob.

SUMMARY OF THE INVENTION

The present invention provides a portable exercise device suitable for use by individuals, ballet studios, gymnasiums, sports facilities and by the individual users of such facilities such as professional dancers, students and athletes. The exercise device provides a versatile, adaptable ballet barre with a diameter approximating conventional ballet barres. The apparatus can be used under wide, diverse circumstances and with a variety of foundations such as pipes, poles, existing wall mounts as well as with conventional barres. The ballet barre of the present invention is hollow to provide a storage compartment for a generally cylindrical support member, and two clamping members. Additionally, a separate storage compartment is provided sufficiently large to enclose small objects that the individual may wish to carry, such as ballet slippers, valuables or keys. A result of the uniqueness of the device is its functional versatility and light weight portability.

To assemble the exercise device, the first clamping member, a T-clamp, is inserted in a transverse opening near the center of the barre. The T-clamp thus embraces the wall of the barre between its elements. The T-clamp also grips the support member to form a "T" with the barre and support member. A second clamp, a support clamp, located at the distal end of the support member, is used to clamp the exercise device to a fixed object. The support clamp may be rotated around the object to permit the barre to be located either above, horizontal to or below the object to which the exercise device is affixed. Should it be desired, the barre could also be attached to a pre-existing fixed surface and used vertically, in a perpendicular position.

The versatility in orienting the barre with regard to a fixed object provides a distinct advantage over permanently mounted barres. The present invention may be used as a temporary barre either above or below a permanently mounted barre to accommodate men, taller females, shorter dancers and children. Alternatively, the exercise device of the present invention may be mounted on a pipe or other such fixed object in a theater and oriented such that the support member is parallel to the ground to allow professional dancers to warm up with a barre in a theater.

Specifically, the present invention comprises: a portable exercise device including support means having a first and second end, mounting means operatively connected to the first end of the support means for mounting the first end of the support means to a fixed object, a barre having two ends, and coupling means for releasably securing the second end of the support means to the barre between the ends of the barre.

In an alternative embodiment, spacing bushings may be added to extend the length of the support means. The addition of spacing bushings increases the distance of the barre away from the fixed object. Thus, for example, exceptionally tall men could add one or more spacing bushings to further increase the height of the present invention over a permanently wall mounted barre in a ballet studio.

BRIEF DESCRIPTION OF THE DRAWINGS

These and other features of the present invention may be more fully understood from the following detailed description, taken together with the accompanying drawings, wherein similar reference characters refer to similar elements throughout and in which:

FIG. 1 is a perspective view of a ballerina using a portable barre constructed according to a preferred embodiment of the present invention;

FIG. 2 is a sectional view taken along the line 2—2 of FIG. 1, illustrating the interconnection of the elements of the present invention;

FIG. 3 is a partial sectional view taken along the line 3—3 of FIG. 2, shown in isolation to illustrate the position of the T-clamp within the barre after the T-clamp embraces the barre;

FIG. 4 is a perspective view of the barre, the shaft and base, illustrating the insertion of the shaft and base into the barre through a lateral hole in the barre wall;

FIG. 5 is a perspective view of the barre, the shaft, the saddle and the locking nut, illustrating the clamping of the T-clamp to the barre;

FIG. 6 is a sectional view of the support member, taken along the line 2—2 of FIG. 1, illustrating the insertion of the support clamp into a recess of the locking element;

DESCRIPTION OF THE PREFERRED EMBODIMENT

Referring to FIG. 1, a preferred embodiment of a portable exercise device constructed according to the present invention has a ballet barre 10 clamped to a support member 12 to form a "T". A support clamp 14 acts as a mounting means to operatively connect the distal end of the support member 12 to a fixed object or foundation 16.

Figure 1A:
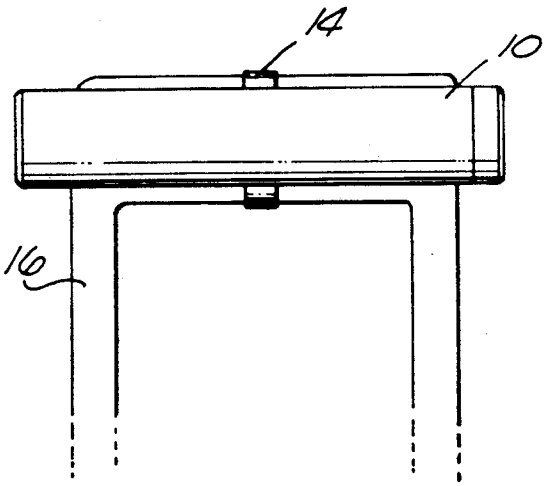
FIGS. 1A through 1D show perspective views of the barre in various positions of use.

FIG. 1A illustrates the use of the portable exercise device in a position parallel to its support. If, for example, a large, horizontal pipe is available for support, the present invention may be mounted to the large pipe with the support clamp 14 and positioned parallel to the pipe. This positioning provides a horizontal barre of an appropriate size for warm-up exercises.

Figure 1B:
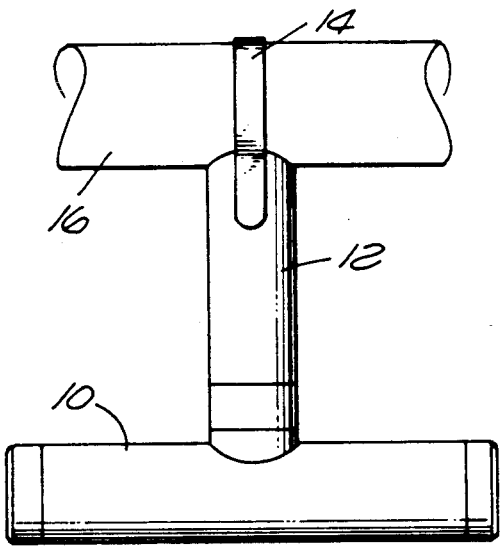
Figure 1C:
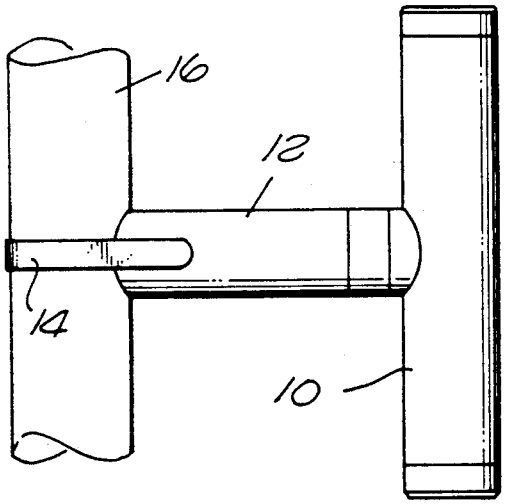
Figure 1D:
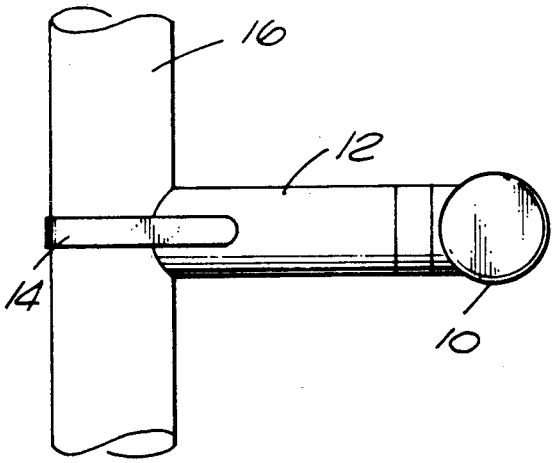

FIG. 1B shows the portable exercise device mounted below its support. Positioning the barre 10 below the foundation 16 allows shorter dancers to exercise with a barre at an appropriate height. FIGS. 1C and 1D illustrate the present invention mounted on a vertical pipe, or other support. As shown, the barre 10 may be positioned either parallel to the vertical foundation 16 (FIG. 1C), or perpendicular to the foundation 16, and thus parallel to the ground (FIG. 1D).

Referring to FIG. 2, a cross-sectional view of the support member and a lateral cross-sectional view of the ballet barre is shown. The ballet barre 10 may be constructed from a cylindrical tube defining a separate storage compartment 18. The diameter of the barre 10 is preferably one and three-fourths inches, approximating the diameter of conventional ballet barres to ease the transition between conventional ballet barres and the present invention. The specific barre 10 illustrated here is thirteen inches in length; from 12 to 14 inches is preferred. It is preferable for high strength per inch weight to construct the barre 10 from aluminum, fiberglass, plastic or other synthetic lightweight material which may be easily, yet securely gripped. The support member 12 may also be a light-weight, hollow metal tube, with an open end 17 and a closed end 19. A T-clamp 20 is incorporated to couple the proximal end of the support member 12 to the barre 10 between the ends of the barre.

The T-clamp 20 is comprised of three elements including an extended, threaded shaft 22 with an arcuate base 24. The base 24 is shaped to mate with an interior wall of the barre 10 with the threaded shaft 22 extending through an aperture 26 in the barre 10 wall. A cylindrical, movable element or saddle 28 has a concave base to allow the saddle 28 base to mate with an outer wall of the barre 10. The saddle 28 also has a chamber 30 extending through its longitudinal axis to permit the saddle 28 to engage with the threaded shaft 22.

The third element of the T-clamp 20 is a threaded, large cylindrical nut 32 adapted to interlock with the threaded shaft 22. The nut 32 is shaped to engage with the top of the saddle 28. Thus, when the nut 32 is rotated to a position against the saddle 28, the T-clamp 20 grips the wall of the barre 10 between the base 24 and the saddle 28.

The distal end of the support member 12 houses the elements incorporated in the support clamp 14 to secure the present invention to the foundation 16. The elements of the support clamp 14 include an anchor 34, which encircles the foundation 16, affixed at both ends to a locking member 36. In the preferred embodiment, the anchor 34 is a flat spring steel strap of sufficient flexibility and width to encircle a wide range of foundations and to secure the present invention in any orientation above, below, parallel or perpendicular to the foundation.

The locking member 36, in the preferred embodiment, is an abbreviated cylinder with a threaded chamber 38 through its longitudinal axis, the diameter of the locking member 36 being slightly smaller than the diameter of the support member 12. Two bores 40 and 42 are juxtaposed on the sides of the locking member 36. The first bore 40 is located at approximately the center of the side of the locking member 36 and is threaded to lockingly engage with a bolt 44 which secures one end of the anchor 34 to the locking member 36. The free end of the anchor 34 is securable to the locking member 36 by means of a snap 46 receivable within the second bore 42. The second bore 42 is located adjacent to a top 48 of the locking member 36.

The support clamp 14 is secured within the support member 12 by inserting the locking member 36 and the anchor 34 into the open end 17 of the support member 12 with the top 48 of the locking member 36 toward the distal, closed end 19 of the support member 12. This action places the anchor 34 within the interior of the support member 12. However, a slot 50, located in the support member 12 wall adjacent to the closed end 19, allows the free end of the anchor 34 to pass out of the interior of the support member 12. The anchor 34 is secured at its free end by reentry into the interior of the support member 12 through a second slot 52, also located in the support member 12 wall adjacent to the closed end 19 and juxtaposed to first slot 50.

As stated above, the free end of the anchor 34 is securable to the locking member 36, now placed within the interior of the locking member 12, by means of a snap 46 receivable within the second bore 42 in the locking member 36. The second slot 52 is positioned in the support member 12 wall such that it provides access to the second bore 42 when the locking member 36 is fully seated against the closed end 19 of the support member 12.

As shown in FIG. 2, the distal, closed end 19 of the support member 12 does not have a flat exterior. Instead, the end 19 forms a V-shaped cavity 54 capable of engagement with a foundation whether it be a circular, oval, rectangular or square foundation.

When assembled, the T-clamp 20 grips the wall of the barre 10 between the base 24 and the saddle 28. As stated above, the nut 32 is secured over the saddle 28 by threaded engagement with the shaft 22 and secures the T-clamp 20 to the barre 10. The support member 12 is mounted to the barre 10 by placing the open end 17 of the support member 12 against the nut 32. This placement results in the shaft 22 extending through the interior of the support member 12 for threaded engagement with the chamber 38 of the locking member 36.

Referring to FIGS. 3 through 5, assembly of the T-clamp 20 is illustrated. As shown in FIG. 4, the base 24 is inserted into a large end 56 of the aperture 26 in the barre 10. Once the base 24 enters the interior chamber of the barre 10, the threaded shaft 22 is rotated and aligned to be perpendicular to the wall of the barre 10 with the arcuate end of the base 24 fully seated against the interior barre 10 wall. Next, the threaded shaft 22 is guided along a groove portion 58 in the aperture 26. This allows the arcuate end of the base 24 to be seated against a larger portion of the interior wall of the barre 10.

Referring to FIG. 5, the saddle 28 is received by the threaded shaft 22 through its axial chamber 30. The saddle 28 is moved down the threaded shaft 22 until the concave base of the saddle 28 is in engagement with the exterior wall of the barre 10. Next, the threaded nut 32 is rotated along the threaded shaft 22 to clamp the saddle 28 firmly against the exterior wall of the barre 10.

As shown in FIG. 3, when the T-clamp 20 grips the wall of the barre 10, the shaft 22 is adjacent to the distal end of the aperture groove 58. The base 24 is seated within the barre 10 storage compartment such that the long axis of the base 24 is perpendicular to the longitudinal axis of the barre 10. Finally, the concave base of the saddle 28 allows the entire surface of the saddle 28 base to mate with the exterior wall of the barre 10.

As shown in FIG. 6, prior to mounting the support member 12 to the barre 10, the locking member 36 is placed adjacent to the closed end 19 of the support member 12. Thus, the second bore 42 in the locking member 36 is visible through the second slot 52 in the support member 12 wall. Next, the threaded shaft 22 is inserted within the interior of the support member 12 and into the axial chamber 38 of the locking member 36. This places the open end 17 of the support member 12 adjacent to the nut 32.

The apparatus is then mounted on the foundation 16 (not shown) by placing the V-shaped cavity 54 of the support member 12 on the foundation 16, wrapping the anchor 34 around the foundation 16 and inserting the snap 46 into the second bore 42 of the locking member 36. The anchor 34 is tightened around the foundation 16 by rotating the barre 10 to fully engage the threaded shaft 22 with the length of the locking member chamber 38. Additional rotations of the barre 10 draw the locking member 36 and the anchor 34 through the interior chamber of the support member 12 and away from the closed end 19. This action reduces the length of the anchor 34 encircling the foundation 16 and secures the present invention for exercise use. When mounted on a fixed foundation, the present invention can withstand a torque of approximately 500 to 700 pounds.

Figure 7:
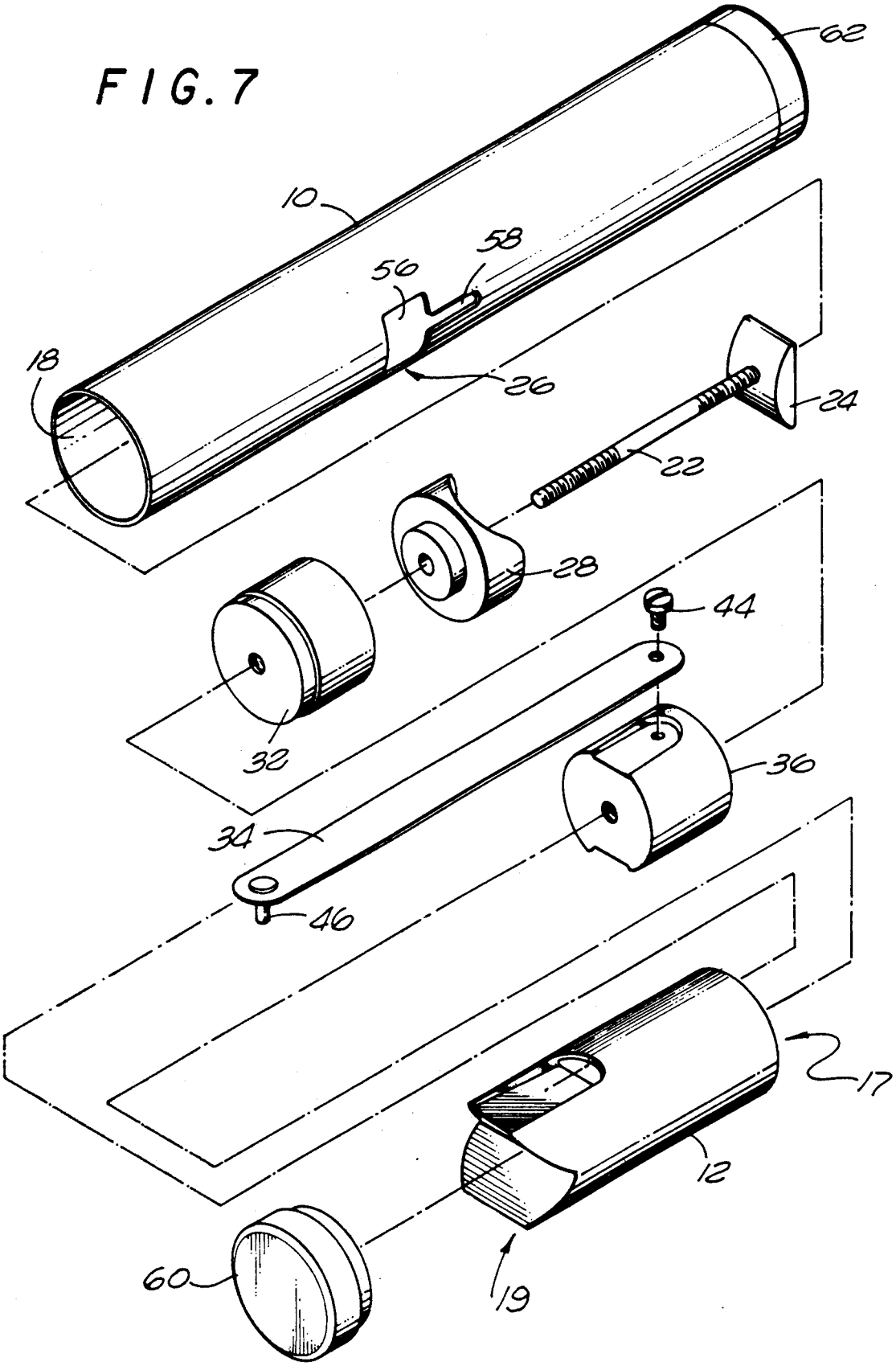
FIG. 7 is an expanded view of the elements of the present invention, illustrating the order in which the elements are placed into the interior compartment of the barre.

Referring to FIG. 7, when the present invention is disassembled, the support and clamping members may be stored within the interior storage compartment 18 of the barre 10. These members are positioned in the storage compartment 18 of the barre 10 by placing the saddle 28 and the nut 32 over the threaded shaft 22 for engagement with the base 24. Next, with the locking member 36 contained within the support member 12, the locking member 36/support member 12 combination is placed over the threaded shaft 22 and rotated to engage the open end 17 of the support member 12 against the nut 32. The support member 12 is then positioned with its open end 17 adjacent to the nut 32. Finally, the anchor 34 is folded over the closed end 19 of the support member 12 and the snap 46 inserted in the second bore 42 in the locking member 36. The members as thus assembled are inserted into the storage compartment 18 of the barre 10.

Two caps 60 and 62 are placed on the open ends of the barre 10 to contain the stored members. These caps may be made from plastic or other suitable materials which may be mounted on, and easily released from the barre 10.

Figure 8:
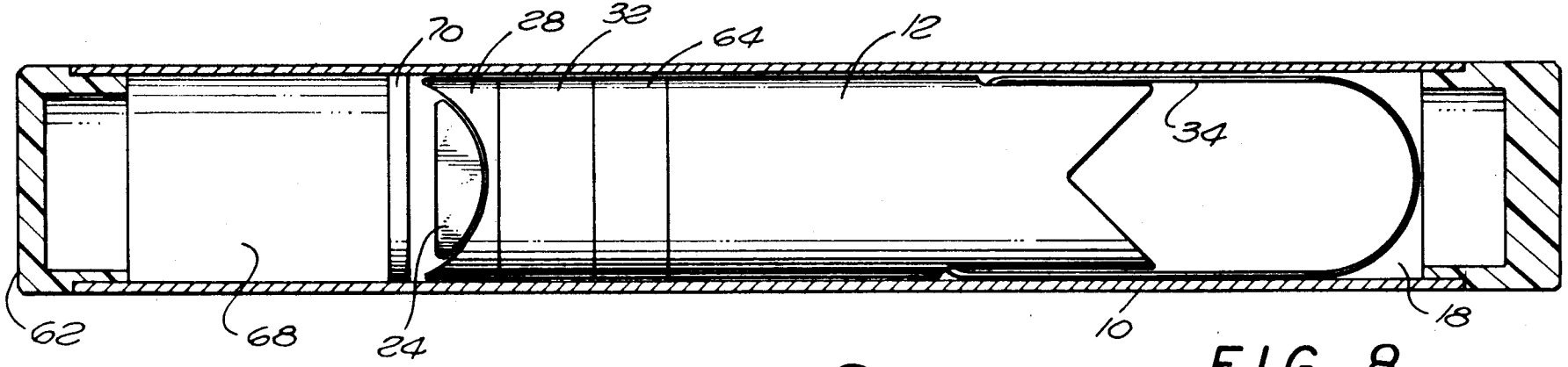
FIG. 8 is a cross-sectional view of the barre and other elements of the present invention upon storage.

As shown in FIG. 8, when the members of the present invention are positioned within the storage compartment 18 of the barre 10, a separate portion of the storage compartment 18 is unoccupied, forming a carrying chamber 68. This unoccupied portion may be used to store valuables, money, keys or the like.

An interior cap 70 may be positioned within the storage compartment 18 adjacent to the base 24 to prevent the members of the present invention from shifting into the carrying chamber 68. Thus, items stored within the carrying chamber 68 will not be crushed if the disassembled invention is transported with the carrying chamber 68 below the stored members.

The compact size of the disassembled and stored exercise device provides a light-weight and portable apparatus which may be carried from foundation to foundation. The total weight of the members of the preferred embodiment is slightly over one pound.

Figure 9:
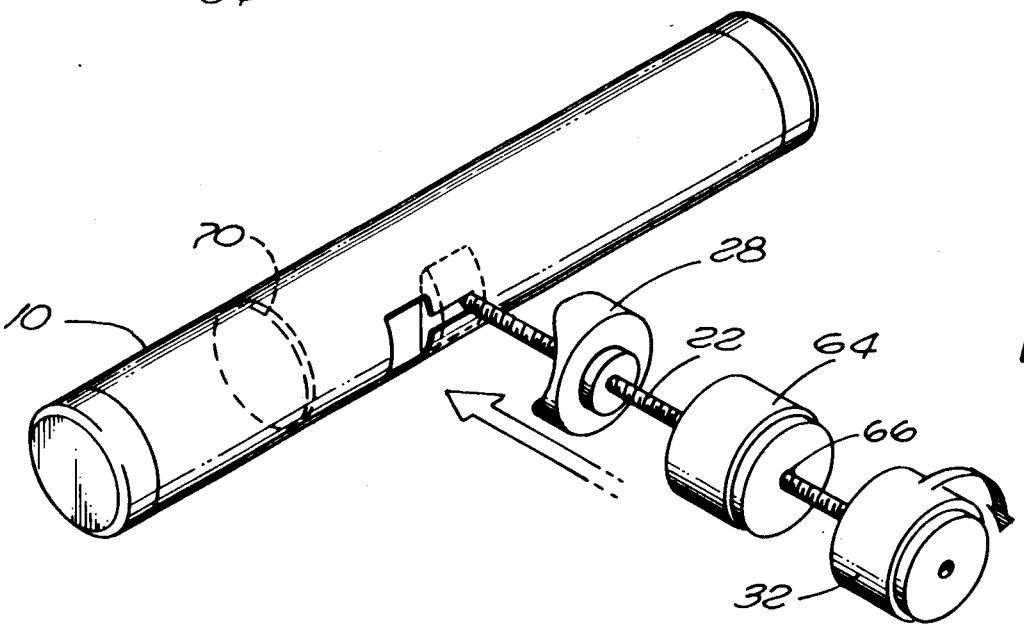
FIG. 9 is a perspective view of the T-clamp illustrating the addition of spacing bushings to extend the length of the support member.

Although described for purposes of clarity with regard to specific preferred embodiments, the present invention is not limited to those embodiments but rather is applicable broadly to all versions falling within the scope and spirit of the appended claims. For example, the length of the support member 12 may be extended by placing a spacing bushing 64 between the nut 32 and the saddle 28, as shown in FIG. 9. Similar to the saddle 28, the spacing bushing 64 has a chamber 66 along its longitudinal axis to allow the spacing bushing 64 to be placed over the shaft 22. More than one bushing 64 can be used or a bushing of thicker or thinner dimensions can be used.

What is claimed is:

1. A portable exercise device comprising:

support means having a first end and a second end;

mounting means operatively connected to the first end of the support means for mounting the first end of the support means to a fixed object;

a bar having two ends; and coupling means for releasably securing the second end of the support means to the bar between the ends of the bar.

2. The exercise device of claim 1 wherein:

the bar defines an interior chamber; and the support means, mounting means and coupling means are receivable within the bar chamber.

3. The exercise device of claim 1 wherein:

the bar is a tube defining an aperture;

the coupling means comprises a threaded shaft with a base, to engage with an interior wall of the bar with the shaft extending through the bar aperture; and a moveable element receivable by the shaft and adapted to engage an exterior wall of the bar;

the support means defines an interior chamber; and the mounting means comprises a locking element receivable within the interior chamber of the support means and having a first end and a second end;

the first end of the locking element defining a threaded interior chamber for engagement with the shaft of the coupling means; and fastening means releasably connected to the locking element to embrace a fixed object.

4. The exercise device of claim 3 wherein:

the fastening means is a strap.

5. The exercise device of claim 1 wherein:

the bar is a tube defining an aperture;

the coupling means comprises a threaded shaft with a base, to engage with an interior wall of the bar with the shaft extending through the bar aperture;

a threaded moveable element receivable by the shaft and adapted to engage an exterior wall of the bar; and a threaded nut for interlocking with the shaft; and the mounting means is a clamp.

6. The exercise device of claim 1 further comprising:

a spacing bushing releasably secured to the second end of the support means.

* * * * *